US006172495B1

(12) United States Patent
Washburn

(10) Patent No.: US 6,172,495 B1
(45) Date of Patent: Jan. 9, 2001

(54) CIRCUIT AND METHOD FOR ACCURATELY MIRRORING CURRENTS IN APPLICATION SPECIFIC INTEGRATED CIRCUITS

(75) Inventor: Clyde Washburn, Victor, NY (US)

(73) Assignee: LSI Logic Corporation, Milpitas, CA (US)

( * ) Notice: Under 35 U.S.C. 154(b), the term of this patent shall be extended for 0 days.

(21) Appl. No.: 09/498,492

(22) Filed: Feb. 3, 2000

(51) Int. Cl.[7] ..... G05F 3/16; G05F 3/20
(52) U.S. Cl. ..... 323/316; 323/313
(58) Field of Search ..... 323/313, 315, 323/316

(56) References Cited

U.S. PATENT DOCUMENTS

| | | | | |
|---|---|---|---|---|
| 5,107,199 | * | 4/1992 | Vo et al. | 323/316 |
| 5,570,009 | * | 10/1996 | Nakamura | 323/315 |
| 5,581,174 | * | 12/1996 | Formen | 323/316 |
| 5,680,037 | * | 10/1997 | Carobolante | 323/315 |
| 5,747,978 | * | 5/1998 | Gariboldi et al. | 323/313 |
| 5,867,014 | * | 2/1999 | Wrathall et al. | 323/316 |
| 5,877,617 | * | 3/1999 | Ueda | 323/316 |
| 5,917,311 | * | 6/1999 | Brokaw | 323/280 |

* cited by examiner

*Primary Examiner*—Peter S. Wrong
*Assistant Examiner*—Bao Q. Vu

(57) ABSTRACT

A method and apparatus for mirroring currents in application specific integrated circuits provides higher current mirroring accuracy than previously obtainable with matched active devices by using small groups of resistors with local matching to create a summing node which represents the average voltage across the source resistors of the active output devices and by forming a reference resistor through the combination of resistors from the local resistor groups such that the reference resistor has properties which will largely cause cancellation of location gradients and initial value variation in the resistor groups. An error amplifier compares the voltage at the summing junction with the voltage across the reference resistor and adjusts its output voltage to drive the paralleled gates of each active mirror output device such that the summing junction and reference resistor voltages remain equal. The number of active devices forming an output array is typically an integer squared, and a local resistor group of three matched resistors is provided for each active mirror device. The error amplifier output voltage driving the gates of the active output devices causes the current flowing through each device to mirror the reference input current flowing through the reference resistor. The result is that the current flowing from the output array of active devices is closely equal to the integer squared times the reference input current flowing in the reference resistor.

16 Claims, 1 Drawing Sheet

CIRCUIT AND METHOD FOR ACCURATELY MIRRORING CURRENTS IN APPLICATION SPECIFIC INTEGRATED CIRCUITS

BACKGROUND OF THE INVENTION

1. Field of the Invention

The present invention is generally directed to a current mirroring circuit. More specifically, the present invention is directed to a circuit and method for mirroring currents in application specific integrated circuits (ASICs) with an accuracy greater than previously obtainable using matched active devices.

2. Background

Various techniques are used to provide regulated current to a load circuit. One such technique involves a current mirroring circuit which is used to provide an output current equal to or proportional to a reference input current. Current mirroring is typically accomplished by putting current through an active reference device such as a bipolar or MOS device. The resulting gate to source voltage in a field-effect transistor (FET) for example, can then be applied to multiple other devices which closely match and are connected to the original reference device. Current which mirrors the reference current then flows through each of the other multiple devices to the extent these devices are identical. A total mirrored current which is larger than the reference current by the same number of times as there are multiple devices connected to the reference device is achieved by combining the device outputs.

An important aspect in the design of current mirroring circuits is achieving an optimum match between the input reference current and the output current of each mirroring device. Since this current mirroring accuracy assumes that the active mirroring devices are fabricated with similar traits, current mirroring circuits are commonly fabricated on monolithic substrates as part of an integrated circuit such as an ASIC. Additionally, nominally equal value resistors are sometimes added in series with the source of each active device to improve the mirroring accuracy. This technique is successful to the extent that the matching of the resistors is better that the matching of the active mirror devices.

Nevertheless, prior art methods of achieving current mirroring accuracy in ASICs or other monolithic integrated circuits continue to suffer from problems in matching active mirror devices, especially where mirroring ratios beyond two are desired. Where higher mirroring ratios are desired, the associated increase in the number of mirror devices precludes placing all the mirror devices directly adjacent to the reference device. Therefore, device mismatch is increased by the gradients of dimensional accuracy and doping as the mirror devices are spread across the chip. The result is a reduction in current mirroring accuracy when higher mirroring ratios are desired because of the necessary reliance on matching the active mirror devices.

Accordingly, there exists the need for a method of mirroring currents in application specific integrated circuits with an accuracy better than obtainable by mirroring with matched active devices.

SUMMARY OF THE INVENTION

A method and apparatus for mirroring currents in application specific integrated circuits provides higher current mirroring accuracy than previously obtainable with matched active devices by using small groups of resistors with local matching to create a summing node which represents the average voltage across the source resistors of the active output devices and by forming a reference resistor through the combination of resistors from the local resistor groups such that the reference resistor has properties which will largely cause cancellation of location gradients and initial value variation in the resistor groups. An error amplifier compares the voltage at the summing junction with the voltage across the reference resistor and adjusts its output voltage to drive the paralleled gates of each active mirror output device such that the summing junction and reference resistor voltages remain equal. The number of active devices forming an output array is typically an integer squared, and a local resistor group of three matched is resistors is provided for each active mirror device. The error amplifier output voltage driving the gates of the active output devices causes the current flowing through each device to mirror the reference input current flowing through the reference resistor. The result is that the current flowing from the output array of active devices is closely equal to the integer squared times the reference input current flowing in the reference resistor.

DETAILED DESCRIPTION OF THE INVENTION

Figure 1:
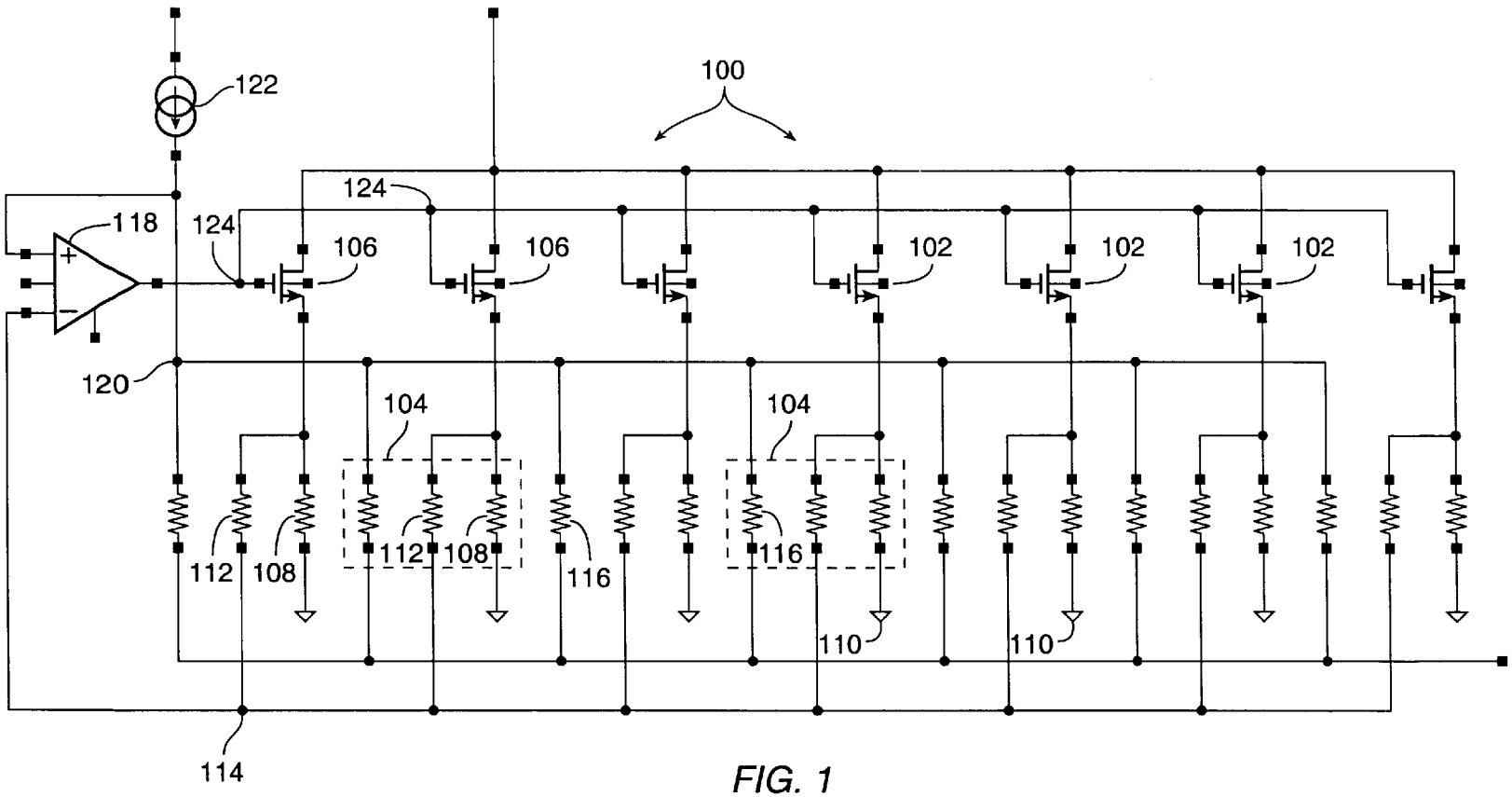
FIG. 1 is a circuit diagram illustrating the use of groups of three matched resistors to implement a high accuracy 49X current mirror in accordance with a preferred embodiment of the present invention.

Those of ordinary skill in the art will realize that the following description of the present invention is illustrative only and not in any way limiting. Other embodiments of the invention will readily suggest themselves to such skilled persons having the benefit of this disclosure.

A specific embodiment of the present invention is illustrated by the current mirroring circuit of FIG. 1 which includes an output array 100 of active devices 102 with a local group of three matched resistors 104 for each source contact 106 of the output array 100. Although the active devices 102 of FIG. 1 are depicted as field-effect transistors (FETs), the circuit is not limited to this implementation. Other active devices known to those skilled in the art for low level signal amplification such as bipolar transistors are within the scope of this disclosure.

The preferred number of active devices 102 is that which permits the total number of source contacts 106 to be an integer squared, such as 49, 64, 81, 100 and so on. In the circuit of FIG. 1 the number of source contacts 106 and the number of active devices 102 is forty-nine. However, in the case of interdigitated devices there would be two active devices connected to each source contact 106, and thus, ninety-eight active devices 102 would be present while still permitting the integer-squared number of forty-nine source contacts 106.

Each group of three matched resistors 104 preferably comprises a resistor located in the physical center of its group of three resistors. This center or source resistor 108 is electrically shown in FIG. 1 as R13, R2, R5, and so on, and is matched to two resistors on either of its sides. Each center resistor 108 is a source degeneration resistor for its corresponding active device 102 and connects from the source contact 106 of that active device 102 to the source supply potential 110 which is assumed to be ground in the specific embodiment of FIG. 1. While it is suggested that the preferred implementation of the current mirroring circuit of FIG. 1 is with the source resistor 108 in the physical center of each group of three resistors 104 so that the two resistors on either of its sides may be equally well matched to it, any physical relationship between the resistors that allows them to be matched adequately for the mirroring accuracy required is within the scope and intent of the present invention.

The first side resistor 112 of each group of three resistor s is electrically shown in FIG. 1 as R14, R1, R4, and so on, and is connected at one end to a center resistor 108 at its source contact 106. A summing junction 114 which represents the average voltage across all the source resistors 118 is formed by connecting the opposite ends of all the first side resistors 112. Other arrangements known to those skilled in the art using any number of resistors which provide a summing junction such that the average voltage or current in the output devices may be accurately discerned is also within the scope and spirit of the present invention.

The second side resistors 116 of each group of three matched resistors are electrically shown in FIG. 1 as R15, R0, R12, and so on, and are arranged in parallel groups of the integer number whose square preferably determines the number of source contacts 106 as described above. The parallel groups of second side resistors 116 are then arranged in a series connection to ground 110. This parallel and series combination of the second side resistors 116 forms a reference resistor whose nominal value is the same as any one of the center/source resistors 108. The physical locations of the second side resistors 116 forming the reference resistor imbue the reference resistor with properties which largely cancel location gradients and initial value variations among the groups of three matched resistors 104. Other arrangements known to those skilled in the art using any number of resistors which provide a reference resistor by combination of resistors such that they acquire characteristics closely that of the average of the source resistors or some useful multiple or submultiple are also within the scope and spirit of the present invention.

Current mirroring in the circuit of FIG. 1 is accomplished by using an error amplifier 118 to compare the voltage at the summing junction 114 with the reference resistor voltage 120 generated by a reference input current 122. The error amplifier 118 controls the voltage to the paralleled gate contacts 124 of each active device 102 in the output array 100 in order to make the summing junction 110 and reference resistor voltages 112 equal. The voltage at the error amplifier 118 output drives the gates 124 of the active output devices 102 causing the current through each device to mirror the reference input current 122 flowing through the reference resistor. The result is that the total current flowing from the output array 100 of active devices 102 is closely equal to the integer squared times the reference input current 122 flowing in the reference resistor.

Advantages of the present invention over prior current mirroring methods include a substantial increase in the accuracy of matching currents produced by large chip areas while requiring only local matching of passive resistor components. Additionally, the current mirroring circuit of the present invention is largely immune to the effects of temperature and process gradients on the chip. The circuit of the present invention provides substantially linear transconductance even though the active output devices may have extremely non-linear control characteristics which results in a constant gain even when there is offset in the feedback amplifier. Finally, the circuit of the present invention works well for large gain-up ratios, whereas conventional active device mirrors become progressively worse for ratios above two.

Alternative Embodiments

While embodiments and applications of this invention have been shown and described, it would be apparent to those skilled in the art having the benefit of this application that many more modifications than mentioned above are possible without departing from the inventive concepts herein. The invention, therefore, is not to be restricted except in the spirit of the appended claims.

What is claimed is:

1. A circuit for mirroring currents in application specific integrated circuits, comprising:

an array of two or more active devices;

a group of three matched resistors corresponding to each active device within said array, said group of three matched resistors having a center resistor, a first side resistor and a second side resistor, said center resistor coupled to a source contact of a corresponding active device as a source degeneration resistor, said first side resistor coupled to a summing junction and said second side resistor coupled as part of a reference resistor;

a current input coupled to said reference resistor;

an error amplifier having a first input coupled to said reference resistor, a second input coupled to said summing junction, and an output coupled to the gate contact of each of said two or more active devices; and a single array output formed by coupling the drain contact from each of said two or more active devices.

2. The circuit as recited in claim 1, wherein said source contact is a plurality of source contacts, said plurality being the square of an integer.

3. The circuit as recited in claim 2, wherein the number of said two or more active devices is equal to the number of said plurality of source contacts.

4. The circuit as recited in claim 2, wherein said reference resistor comprises said second side resistors arranged in parallel groups of said integer, said parallel groups further arranged in a series connection between said current input and ground.

5. The circuit as recited in claim 2, wherein the nominal value of said reference resistor is about equal to the value of any one of said center resistors.

6. The circuit as recited in claim 1, wherein said center resistor is located in the physical center of said group of three matched resistors and said first and second side resistors are located on either side of said center resistor.

7. The circuit as recited in claim 1, wherein said two or more active devices are field-effect transistors.

8. The circuit as recited in claim 1, wherein said two or more active devices are bipolar transistors, said source contact is an emitter contact, said gate contact is a base contact, and said drain contact is a collector contact.

9. A method of mirroring currents in application specific integrated circuits, comprising the steps of:

forming an array of two or more active devices, each of said two or more active devices corresponding to a group of three matched resistors having a center resistor, a first side resistor and a second side resistor;

coupling each center resistor to a source contact of a corresponding active device as a source degeneration resistor;

forming a summing junction by coupling one end of each first side resistor such that said summing junction represents the average voltage across each center resistor;

constructing a reference resistor between a current input and ground by combining each second side resistor such that said reference resistor has properties consistent with the resistors from each group of three matched resistors;

comparing voltage across said reference resistor with voltage at said summing junction and adjusting voltage at the gate contacts of said two or more active devices to make the voltage across said reference resistor equal to the voltage at said summing junction; and coupling each drain contact from said two or more active devices to form a single array output.

10. The method as recited in claim 9, wherein said source contact is a plurality of source contacts, said plurality being the square of an integer.

11. The method as recited in claim 10, wherein the number of said two or more active devices is equal to the number of said plurality of source contacts.

12. The method as recited in claim 10, wherein said constructing a reference resistor further comprises the steps of:

arranging said second side resistors in parallel groups of said integer; and forming said parallel groups in a series connection between said current input and ground.

13. The method as recited in claim 10, wherein the nominal value of said reference resistor is about equal to the value of any one of said center resistors.

14. The method as recited in claim 9, wherein said center resistor is located in the physical center of said group of three matched resistors said said first and second side resistors are located on either side of said center resistor.

15. The method as recited in claim 9, wherein said two or more active devices are field-effect transistors.

16. The method as recited in claim 9, wherein said two or more active devices are bipolar transistors, said source contact is an emitter contact, said gate contact is a base contact, and said drain contact is a collector contact.

* * * * *